US005358429A

United States Patent [19]

Mina

[11] Patent Number: 5,358,429

[45] Date of Patent: Oct. 25, 1994

[54] HAZARDOUS LOCATION-RATED PLUG

[75] Inventor: Nabil L. Mina, Roselle, Ill.

[73] Assignee: Appleton Electric Company, Chicago, Ill.

[21] Appl. No.: 112,860

[22] Filed: Aug. 27, 1993

[51] Int. Cl.[5] ..... H01R 13/512; H01R 13/595

[52] U.S. Cl. ..... 439/695; 439/469

[58] Field of Search ..... 439/469, 472, 695, 697, 439/686, 690, 610

[56] References Cited

U.S. PATENT DOCUMENTS

| | | | |
|---|---|---|---|
| Re. 32,787 | 11/1988 | Gallusser et al. | 439/271 |
| 3,430,187 | 2/1969 | DeMan et al. | 439/277 |
| 4,178,056 | 12/1979 | Lee | 439/472 |
| 4,284,318 | 8/1981 | Wiley et al. | 439/472 |
| 4,563,049 | 1/1986 | Thibeault | 439/462 |
| 4,676,575 | 6/1987 | Denlinger et al. | 439/271 |
| 4,857,006 | 8/1989 | Linyeau et al. | 439/271 |
| 4,917,620 | 4/1990 | Samejima et al. | 439/271 |
| 5,108,303 | 4/1992 | Maeda et al. | 439/271 |
| 5,114,359 | 5/1992 | Chishima et al. | 439/271 |
| 5,135,404 | 8/1992 | Clark et al. | 439/469 |
| 5,167,527 | 12/1992 | Clark | 439/469 |

*Primary Examiner*—Gary F. Paumen

*Attorney, Agent, or Firm*—Jones, Day, Reavis & Pogue

[57] ABSTRACT

An electrical plug for an associated electrical device for use in hazardous locations, comprising a metal housing; a nonconductive plug base holding at least two conductive terminal prongs connected to conductor wires passing through the housing and connected at their other end to the electrical device; and a plastic sleeve for preventing contact between the conductor wires and the metal housing, providing a bearing surface for the plug base and an elastomeric gasket compressed therebetween, cooperating with a reversible clamp to mechanically grip the conductor wires and prevent their separation from the terminal prongs, and providing simple measurement of a predetermined length of wire between the clamp and each terminal. A rubber grommet provides a moisture-resistant seal along the back end of the plug housing. A label plate may be affixed to the exterior surface of the plug housing by means of peened over posts that do not interfere with the integrity of the plug housing.

16 Claims, 3 Drawing Sheets 10
12
14
16
18
20
22
26
28
30
32
34
36
38
40
44
46
48
50
52
54
56
58
59
60
62
64
68
70
72
74
76
78
80
3

HAZARDOUS LOCATION-RATED PLUG

BACKGROUND OF THE INVENTION

The present invention relates generally to electrical plugs, and more specifically to such a plug of simplified design for use in hazardous locations.

Electrical plugs used to deliver electrical current from an energized receptacle to an electrical device, such as a motor, piece of machinery, etc., are well known in the art. Generally, they consist of a cable or cord containing two or more conductor wires that are attached to an equal number of terminals fixed in a support housing. Once the plug is inserted into the receptacle, current travels through the terminals and conductor wires to the electrical device.

Because it is important to prevent migration of moisture into the plug housing that could interfere with the electrical current and cause safety hazards, these plugs are generally provided with one or more sealing gaskets made from an elastomeric material. Portions of the housing or an electrical connector cooperate to exert compressive forces against the gasket to enhance the moisture-resistant seal. Examples of plug housings or electrical connectors using such gasket seals include U.S. Pat. Nos. 5,108,303 issued to Maeda, et al.; 4,917,620 issued to Samejima et al.; 5,114,359 issued to Chishima et al.; Reissue No. 32,787 issued to Gallusser et al.; 4,857,006 issued to Linyeav et al.; 4,676,575 issued to Denlinger et al.; and 3,430,187 issued to deMan et al.

While the conductive terminals have been traditionally connected to the conductor wires through the face of the plug to form a so-called "live-front" plug, the recent trend within the industry has been toward the much safer "dead-front" design in which the terminals are wired from the back of the insulative plug facing, which contains slots through which only the terminal prongs protrude. DeMan, as well as U.S. Pat. Nos. 4,563,049 issued to Thibeault, 4,284,318 issued to Wiley et al.; and 4,178,056 issued to Lee, illustrate this dead-front plug design.

Because of pulling forces frequently applied to the conductor wires due to the operator or operating electrical device, the wires may become disengaged from one or more of the plug terminals to create risks of a short circuit or injury to the operator. Therefore, the plug must include a means that mechanically grips the exterior surfaces of the conductor wires in order to relieve the strain imposed upon individual wires at the terminal junctions. Several different clamping devices are used in the trade to achieve this objective. In deMan, for instance, an end cap and intermediate housing section cooperate to define a chamber in which a compressed gasket engages the conductor side wall to provide a mechanical grip. In Lee, a set screw biases a metal prong against the conductor sidewall. The plug disclosed by Thibeault includes two cord grips protruding from the plug housing that are biased by a cooperating end cap into engagement with the conductor sidewall. Finally, the plugs taught by Wiley and Clark include two clamp halves that are secured around the conductor by means of screws.

As a measure of added safety, the plug housing portions are generally made from a non-conductive material like plastic with only the terminal prongs made from metal, as taught by Thibeault, Wiley, Lee, and deMan. In the case of accidental separation of the conductor wires from the terminal prongs, such a design prevents short circuits and transmission of current to a metal housing that could cause substantial safety hazards.

For plugs used in hazardous locations where gases, dust, and other ambient particulate matter can explode when ignited, it is important to isolate arc-producing devices like plugs so that ignition of such matter within the plug housing will not spread to the equally explosive environment outside the housing. Therefore, the housing usually must be made from a material like a thick-wall cast aluminum in order to contain any such explosions. The risk of a short circuit should a conductor wire separate from a terminal is alleviated by interposing a plastic-insulating liner between the metal housing and exposed conductor wires. See, e.g., U.S. Pat. No. 5,135,404 issued to Clark et al.

An alternative prior art plug design 10 sold by Appleton Electric for use in hazardous locations is shown in FIGS. 1–3. It comprises an upper housing 12 containing a cylindrical side wall 14 and an end wall 15 defining a plug chamber 16. Located along the interior surface of side wall 14 is shoulder 18 and two ears 20 containing threaded bores 22 therein. End wall 15 of upper housing 12 includes a passageway 26 cut therethrough, and two posts 28 extending therefrom with semicircular niches 30 formed therein, one such post 28 being shown in FIG. 2.

First and second clamp halves 32 and 34, respectively, feature a plurality of elliptically-shaped teeth 36 along the inner surface that are offset with respect to each other when the clamp halves are fastened together by means of screws 38 and threaded receptacles 40 to secure the conductor wires (not shown). Clamp halves 32 and 34, and the conductor wires, in turn, are retained by upper housing 12 by means of engagement of niches 30 by screws 38.

Conductor wire clamps 32 and 34 are covered by lower housing 44 that comprises cylindrical side wall 46 having two annular bores 48 therethrough, and end wall 50 having a circular hole 52 formed therein. An elastomeric grommet 54 with an annular niche 56 along its exterior perimeter surface is pressed into hole 52 of lower housing end wall 50 so that annular niche 56 is engaged by end wall 50.

Lower housing 44 is secured to upper housing 12 with an elastomeric gasket 60 positioned therebetween by means of screws 62 that pass through annular bores 48 in lower housing 44, and enter threaded pockets (not shown) in ears 64 protruding from upper housing 12. A hole in grommet 60 permits the conductor wires to pass into plug chamber 16, while minimizing moisture penetration therein.

A nonconductive plug base 68 through which a plurality of terminal prongs 70 made from a conductive material protrude is secured to the open end of upper housing 12 by means of screws 72 that engage the threaded surfaces of bores 22. Plug base 68 actually bears against shoulder 18 of upper hosing 12, compressing elastomeric gasket 74 therebetween to provide a moisture-resistant seal. Connected to the other ends of terminal prongs 70 are fasteners 76 for accepting the individual wires of the conductor. These fasteners could comprise lugs and set screws. Partition wall 78 extends from the bottom surface of plug base 68 to separate the conductor wires at the point where they are secured to terminal fasteners 76 in order to reduce the possibility of short circuits. Finally, a sleeve 80 made from an insulative material like plastic lines the interior surface of upper housing side walls 14 in order to prevent short circuiting between the conductor wires and the housing walls that are made from aluminum material to render plug 10 suitable for use in hazardous locations.

In this manner, plug 10 will: communicate electrical current from terminal prongs 70 and the conductor wires to an associated motor, machine, etc.; securely hold the conductor wires with respect to the plug terminals 70 to reduce the likelihood of separation of the wires from terminal fasteners 76 should they be pulled; prevent short circuits between the conductor wires and housing side wall 14 by means of insulating sleeve 80; and reduce moisture penetration into the plug housing by means of elastomeric gaskets 54, 60, and 74.

However, the design of plug 10 suffers from several disadvantages. First, shoulder 18 must be cast into upper housing 12 to provide a bearing surface for gasket 74 and plug base 68. Second, separation of clamp halves 32, 34 from upper housing 12 requires the presence of lower housing 44 to protect the clamped conductor wire in hazardous locations. Third, plug 10 requires a large number of intricately shaped parts that must be machined perfectly to permit cooperative engagement. Fourth, the label plate for plug 10 needs to be screwed to the exterior surface of upper housing side wall 14 by means of holes 58 formed in the sidewall that can allow moisture penetration into the plug housing.

SUMMARY OF THE INVENTION

Accordingly, it is an object of the present invention to provide an electrical plug for use in hazardous locations.

Another object of the present invention is to provide an apparatus that will securely clamp the conductor wires to reduce the likelihood of their separation from the plug terminals.

Yet another object of the present invention is to provide an apparatus that insulates the conductor wires from the metal plug housing.

Still another object of the present invention is to provide an apparatus that prevents moisture penetration into the plug housing.

Yet another object of the present invention is to provide such an apparatus of a simplified design to reduce manufacturing and materials costs.

Still another object of the present invention is to provide such an apparatus with an exterior label plate that is secured thereto without the need to form holes in the housing wall that could interfere with the integrity of the hazardous location-rate plug.

Other objects of the invention, in addition to those set forth above, will become apparent to those skilled in the art from the following disclosure.

Briefly, the invention is directed to providing an electrical plug for an associated electrical device for use in hazardous locations, comprising a metal housing; a nonconductive plug base holding at least two conductive terminal prongs connected to conductor wires passing through the housing and connected at their other end to the electrical device; and a plastic sleeve for preventing contact between the conductor wires and the metal housing, providing a bearing surface for the plug base and an elastomeric gasket compressed therebetween, cooperating with a reversible clamp to mechanically grip the conductor wires and prevent their separation from the terminal prongs, and providing simple measurement of a predetermined length of wire between the clamp and each terminal. A rubber grommet provides a moisture-resistant seal along the back end of the plug housing. A label plate may be affixed to the exterior surface of the plug housing by means of peened over posts that do not interfere with the integrity of the plug housing.

DETAILED DESCRIPTION OF THE PREFERRED EMBODIMENT

Figure 4:
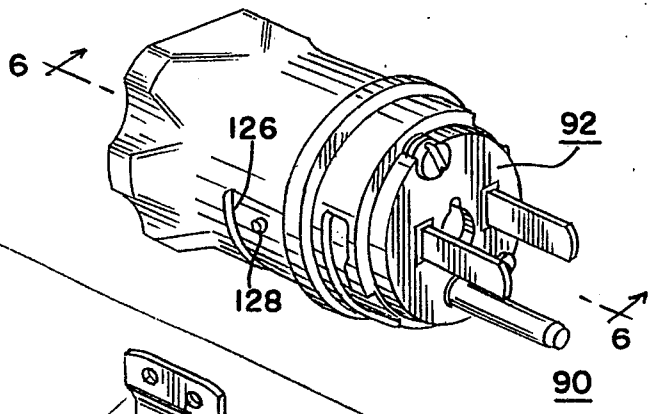
FIG. 4 shows a perspective view of the electrical plug of the present invention.
Figure 5:
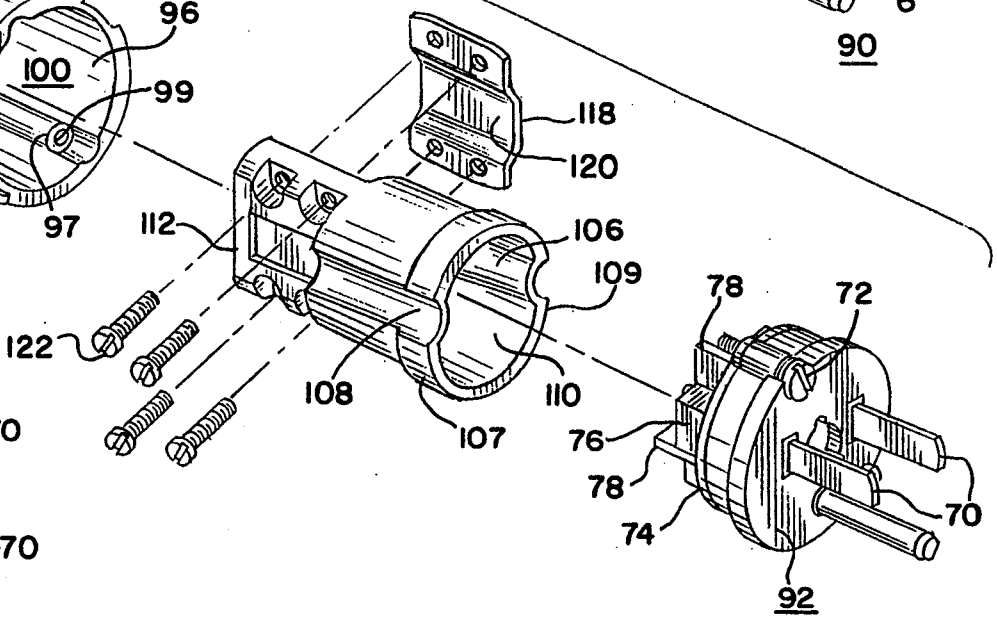
FIG. 5 shows an exploded perspective view of the plug shown in FIG. 4.
Figure 5:
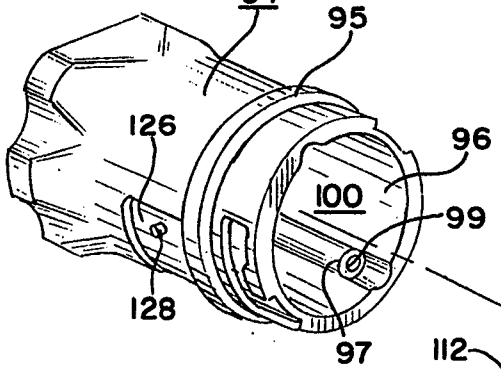
Figure 6:
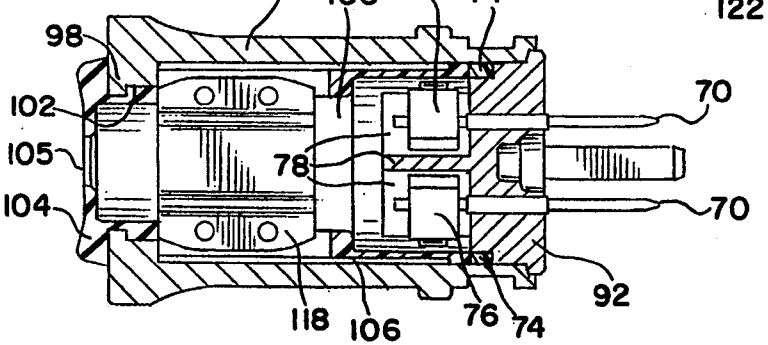
FIG. 6 shows a sectional view of the plug taken along line 6—6 of FIG. 4.

As illustrated in FIGS. 4–6 of the drawings, plug base 92 of electrical plug 90 is the same as that shown as plug base 68 of prior art plug 10, and like numbers have been used to show the various parts.

Housing 94 is made from a die-cast aluminum material, so as to contain explosions that may erupt within plug 90. It comprises a smooth side wall 96 without shoulder 18 of prior art plug 10. Side wall 96 and end wall 98 combine to define plug chamber 100. A hole 102 formed in end wall 98 allows passage of the conductor wires into plug chamber 100. An elastomeric grommet 104 similar to grommet 54 ensures a moisture-resistant seal, while accommodating a wide variety of conductor sizes.

Inserted within plug chamber 100 is insulating sleeve 106 made of a nonconductive material like plastic. Its cylindrical sleeve wall has recessed regions 108 that fit around fastening posts 97 integrally connected to the interior surface of housing side wall 96. If desired, the fastening posts (and therefore recessed sleeve regions) may be located at two points not on the diameter of the circular cross-section of the housing side wall 96, so that sleeve 106 and plug base 92 may be inserted into plug chamber 100 only in a single orientation.

The thickness of sleeve side wall 110 is such that it directly provides a bearing surface 109 against which gasket 74 is compressed once plug base 92 is secured to housing 94 by insertion of screws 72 into threaded bores 99 in fastening posts 97. If desired, a portion 107 of sleeve side wall near the bearing surface 109 may be reinforced to provide a larger bearing surface 109. Sleeve 106 prevents accidental contact between the metal housing wall 96 and conductor wires that become detached that might otherwise cause a short to the grounding which may create a safety hazard.

Figure 5A:
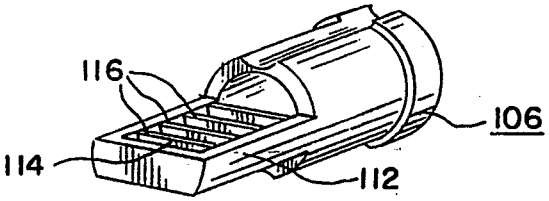
FIG. 5*a* shows a perspective view of the insulating sleeve of the present invention.

Integrally connected to the end of sleeve 106 opposite to bearing surface 109, and extending therefrom is a wing 112 having a concave region 114 with a plurality of teeth 116 (See FIG. 5*a*). Metal plate 118 has its own concave region 120 that cooperates with wing 112 when secured by means of screws 122 to provide a clamp that retains the conductor wires within a passage defined by concave regions 114 and 120. It will be readily appreciated that metal plate 118 may be reversibly connected to wing 112, so as to increase or diminish the size of the passage for different conductor diameters. Teeth 116 enhance the mechanical grip of the clamp, which will withstand pulling forces on the conductor wires of at least 150 lbs.

Assembly of plug 90 is simple. First, the conductor wire ends are stripped and inserted through hole 105 in gasket 104, housing 94, sleeve 106, whereupon they are secured to fasteners 76 of plug base 92. Next, bearing surface 109 of sleeve 106 is pressed against gasket 74, and metal plate 118 is secured to wing 112 to form a clamp to immobilize the portion of the conductor wires connected to terminal prongs 70. Then the other ends of the conductor wires are pulled to draw the sleeve 106/plug base 92 assembly inside plug chamber 100. Because the combined length of sleeve 106 and wing 112 is the same as the distance between end wall 98 and the upper end of fastening posts 97, gasket 74 and the lower surface of plug base 92 will be conveniently brought into contact with fastening posts 97 so that screws 72 may connect plug base 92 to housing 94. Thus, unlike prior art plug base 10, there is no need to premeasure the length of conductor wire necessary between the terminals and clamp for proper wiring and assembly of the plug.

Figures 1, 2, 3:
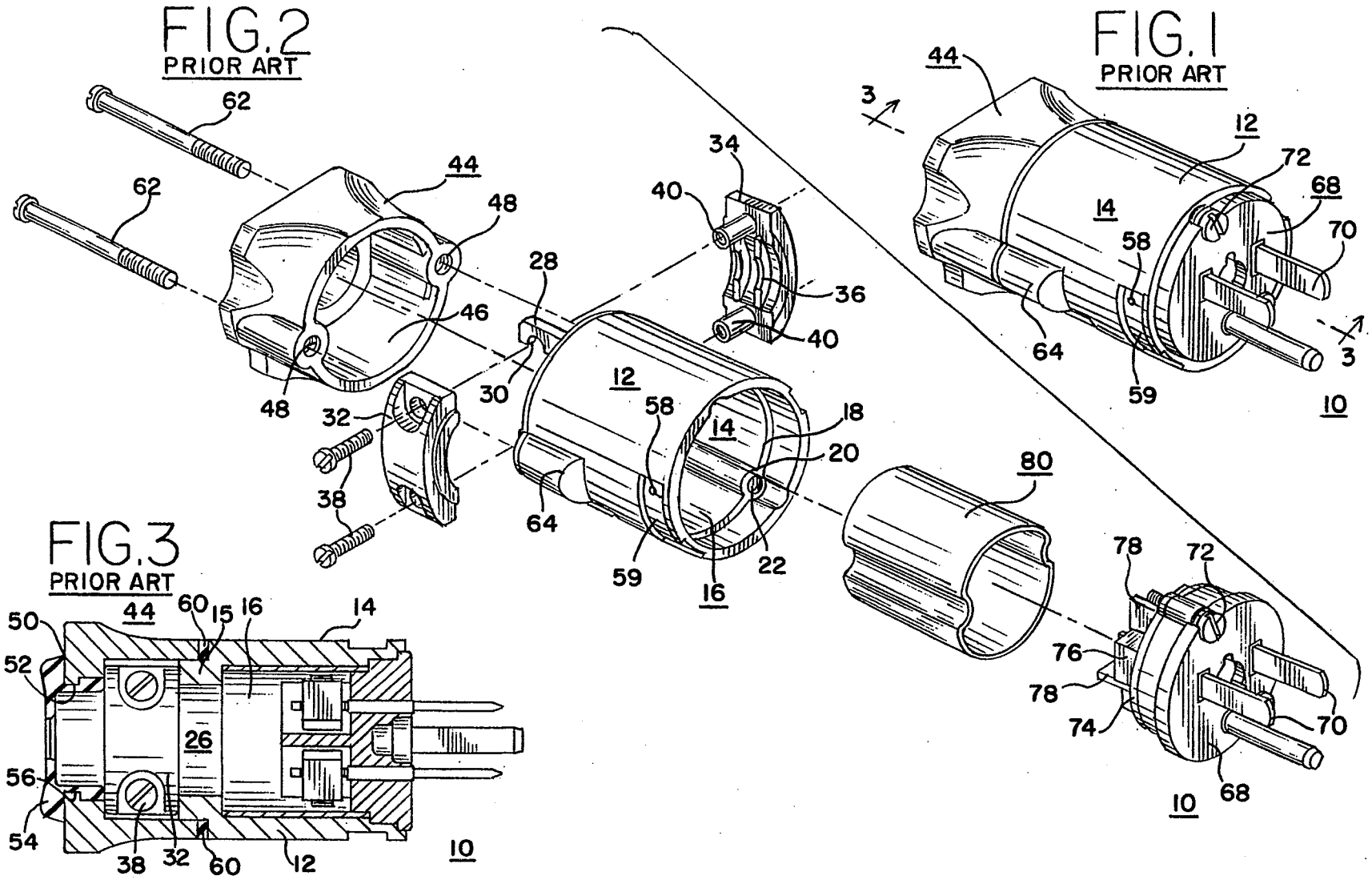
FIG. 1 PRIOR ART
FIG. 2 PRIOR ART
FIG. 3 PRIOR ART
FIG. 1 shows a perspective view of a prior art electrical plug.
FIG. 2 shows an exploded perspective view of the prior art plug shown in FIG. 1.
FIG. 3 shows sectional view of the prior art plug taken along line 3—3 of FIG. 1.

It is common in the trade to affix metal label plates to plug housings that contain written indicia, such as the manufacturer's name, model information, serial number, electrical rating, NEC classifications, and UL listing. Typically, this plate has a hole formed near either end so that it may be attached to the plug housing by means of screws that enter corresponding holes drilled in the housing wall (see hole 58 in FIGS. 1–2). A recessed region 59 may likewise be provided of approximately the same dimensions as that of the label plate so that the label plate will be flush with the exterior surface of the housing wall 14 when attached thereto.

In the present invention shown in FIGS. 4–5, a recessed region 126 likewise is provided. However, two metal posts 128 integral to housing wall 96 extend therefrom. The label plate (not shown) is attached to the plug housing simply by inserting posts 128 through the holes in the plate, and then peening the ends of the posts to provide abutment surfaces that captivate the plate. In this manner, the label plate may be secured to the plug housing 94 without drilling holes therethrough that might enable moisture to penetrate the housing wall, and interfere with the integrity of the hazardous location-rated enclosure.

Figure 7:
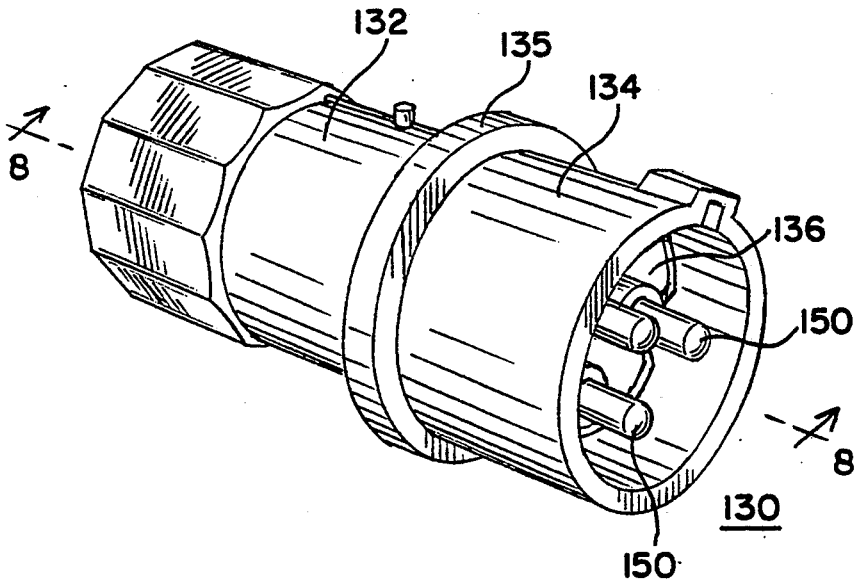
FIG. 7 shows the plug of the present invention with an alternative plug base design.
Figure 8:
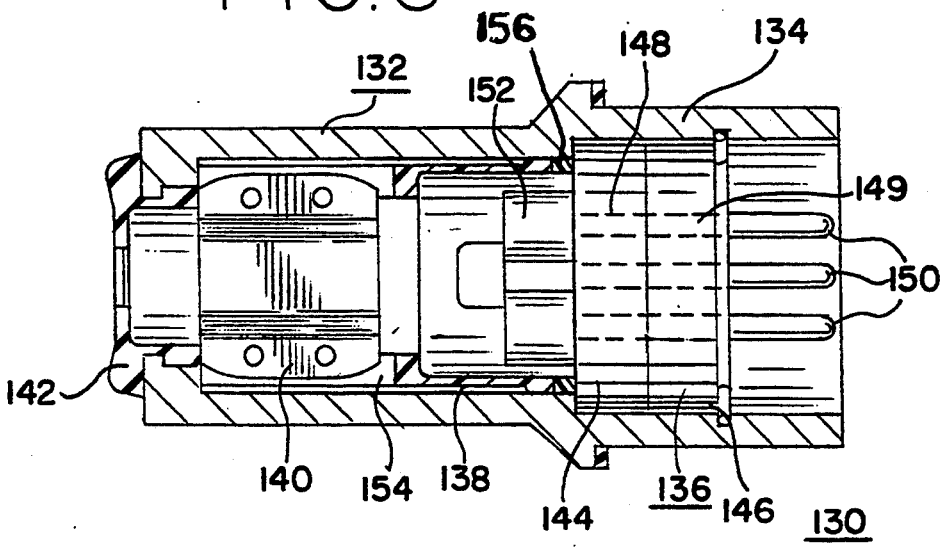
FIG. 8 shows a sectional view of the alternative plug taken along line 8—8 of FIG. 7.

The plug design shown in FIGS. 4–6 is suitable for electrical devices requiring currents characterized by 20–100 amps and 120–600 volts. A plug 130 having a different terminal configuration is shown in FIGS. 7–8. As can be seen in FIG. 8, the housing 132 is similar to housing 94 except for an integral metallic collar 134 that extends around the plug base 136. The same insulating sleeve 138, integrally connected clamp 140, and elastomeric gasket 142 are employed.

Plug base 136, however, comprises first and second nonconductive members 144 and 146, respectively, having cooperating holes 148 and 149 bored therethrough. Three round terminal prongs 150 are inserted through holes 148 and 149 to protrude into the region defined by collar 134, the other ends of the terminal prongs having fasteners 152 suitable for attaching the ends of a conductor wires (not shown). Although plug base 136 is of a different design than plug base 92, it functions the same in all other respects as the plug embodiment 90 shown in FIGS. 4–6, including insulating sleeve 138 that: prevents short circuits between the conductor wires and metal housing wall 132; provides a bearing surface for the plug base, and a gasket 156 compressed therebetween; and securely clamps the conductor wires within plug chamber 154 to relieve stress upon the connection of the wires to the plug terminals.

In addition, plugs 90 and 130 may be provided with shoulders 95 and 135 respectively, that surround the exterior surface of plug housings 94 and 132 near the open ends thereof. Such a shoulder is designed to engage a front rubber gasket of the associated receptacle to provide an extra seal that prevents penetration of moisture, dust, or other particulate matter into the hazardous location-rated receptacle.

While particular embodiments of the inventions have been shown and described, it should be understood that the invention is not limited thereto, since many modifications may be made. The invention is therefore contemplated to cover by the present application any and all such modifications which fall within the true spirit and scope of the basic underlying principles disclosed and claimed herein.

What is claimed is:

1. An electrical plug for connection to an associated electrical device by means of conductor wires, for use in hazardous locations for delivering current from an energized receptacle to said plug, comprising:

(a) a metal housing comprising a cylindrically-shaped side wall and an end wall for defining a plug chamber, the end wall having a hole for permitting the conductor wires to enter said plug chamber;

(b) a cylindrically-shaped sleeve made from a nonconductive material having an outside diameter slightly less than that of the inside diameter of said plug chamber, said sleeve being positioned inside said plug chamber so that one end abuts the end wall of said metal housing, and the opposite end provides a bearing surface, said sleeve insulating the conductor wires from accidental contact with the metallic surface of said housing side wall;

(c) a dead-front plug base comprising a nonconductive base portion having at least two holes bored therethrough, a like number of conductive line terminal prongs protruding through said holes having a first end for insertion into the receptacle, and a second end connected to fastening means for securing the ends of the conductor wires to the terminal prongs, said plug base fitting inside said plug chamber in abutted relation to the bearing surface of said insulating sleeve to cover the open end of said plug housing; and (d) means for securing said plug base to said plug housing to provide a secure seal for containing any ignited hazardous materials inside said plug.

2. An electrical plug as recited in claim 1, wherein said securing means comprises screws that pass through holes formed in the perimeter of said plug base portion, and engage threaded holes tapped inside the side wall of said metal housing.

3. An electrical plug as recited in claim 1, wherein said terminal prongs are molded into the nonconductive base portion of said plug base.

4. An electrical plug as recited in claim 1, further comprising an elastomeric gasket surrounding the base portion of said plug base so that when said plug base is inserted into said plug chamber against the bearing surface of said insulating sleeve, and secured to said metal housing, said gasket is compressed to provide a moisture-resistant seal between said plug base and said housing.

5. An electrical plug as recited in claim 1, wherein said insulating sleeve is made from plastic.

6. An electrical plug as recited in claim 1, further comprising a thickened wall region adjacent to the bearing surface of said insulating sleeve to provide an enhanced bearing surface for said plug base.

7. An electrical plug as recited in claim 1, further comprising clamping means integrally connected to said insulating sleeve for mechanically gripping the conductor wires to prevent their accidental separation from the terminal fastening means.

8. An electrical plug as recited in claim 7, wherein said clamping means comprises a wing integrally connected to and extending from the end of said insulating sleeve opposite to said bearing surface, and a clamp plate secured to said wing by means of at least two screws.

9. An electrical plug as recited in claim 8, further comprising a concave region molded into the interior surface of said wing for accommodating a variety of conductor wire diameters.

10. An electrical plug as recited in claim 8, further comprising a plurality of teeth molded into the interior surface of said wing for enhancing the mechanical grip of said clamp means.

11. An electrical plug as recited in claim 9, wherein said clamp plate has an offset region opposite to the concave region of said wing, so that said clamp plate may be reversibly connected to said wing to enlarge or diminish the size of the conductor wire opening defined by the concave region of said wing and the offset region of said clamp plate.

12. An electrical plug as recited in claim 7, wherein said clamping means will mechanically grip the conductor wires against at least 150 lbs of pulling force exerted on the wires.

13. An electrical plug as recited in claim 1, further comprising an elastomeric grommet for insertion into the hole formed in the end wall of said housing, and having a hole therein for accommodating a variety of conductor wire diameters, while preventing penetration of moisture into said plug housing.

14. An electrical plug as recited in claim 1, further comprising an indented region along the exterior surface of said plug housing for accommodating a label plate, and means for affixing the label plate to said plug housing.

15. An electrical plug as recited in claim 14, wherein said affixing means comprises at least two posts integrally extending from the exterior surface of said plug housing, said posts passing through corresponding holes in the label plate, and being peened over to attach the label plate to said plug housing.

16. An electrical plug as recited in claim 1, further comprising a shoulder extending from the exterior surface of said plug housing near the plug base end thereof, said shoulder positional to engage a front rubber gasket in the associated receptacle to prevent penetration of moisture and particulate matter into the receptacle.

* * * * *